US008776642B2

(12) United States Patent
Weinrotter et al.

(10) Patent No.: US 8,776,642 B2
(45) Date of Patent: Jul. 15, 2014

(54) SOCKET WRENCH FOR ASSEMBLING A LASER IGNITION SYSTEM

(75) Inventors: Martin Weinrotter, Stuttgart-Botnang (DE); Karl-Heinz Nuebel, Simmozheim (DE); Pascal Woerner, Stuttgart (DE); Juergen Raimann, Weil der Stadt (DE)

(73) Assignee: Robert Bosch GmbH, Stuttgart (DE)

( * ) Notice: Subject to any disclaimer, the term of this patent is extended or adjusted under 35 U.S.C. 154(b) by 334 days.

(21) Appl. No.: 13/201,146

(22) PCT Filed: Feb. 2, 2010

(86) PCT No.: PCT/EP2010/051229

§ 371 (c)(1),
(2), (4) Date: Nov. 9, 2011

(87) PCT Pub. No.: WO2010/091976

PCT Pub. Date: Aug. 19, 2010

(65) Prior Publication Data

US 2012/0118114 A1 May 17, 2012

(30) Foreign Application Priority Data

Feb. 12, 2009 (DE) ..... 10 2009 000 798

(51) Int. Cl.
*B25B 13/06* (2006.01)
*B25B 13/48* (2006.01)

(52) U.S. Cl.
CPC ..... *B25B 13/06* (2013.01); *B25B 13/481* (2013.01)
USPC ..... 81/124.2

(58) Field of Classification Search
USPC ..... 81/124.2, 124.3, 124.6, 124.7; 362/119, 362/253
See application file for complete search history.

(56) References Cited

U.S. PATENT DOCUMENTS

| | | | | |
|---|---|---|---|---|
| 4,324,158 | A * | 4/1982 | Le Roy | 81/60 |
| 4,393,583 | A * | 7/1983 | Zwald | 29/857 |
| 4,749,251 | A * | 6/1988 | Moulin | 385/78 |
| 5,031,981 | A * | 7/1991 | Peterson | 385/56 |
| 5,425,290 | A * | 6/1995 | Fought et al. | 81/44 |
| 5,899,554 | A * | 5/1999 | Hsu | 362/119 |
| 6,135,607 | A * | 10/2000 | Cook | 362/119 |
| 6,725,747 | B2 * | 4/2004 | Erwin | 81/124.2 |
| 6,938,522 | B1 | 9/2005 | Stannik | |
| 7,249,540 | B1 | 7/2007 | Hacker et al. | |
| 7,347,129 | B1 | 3/2008 | Youtsey | |
| 2008/0087145 | A1 | 4/2008 | Youtsey | |
| 2010/0282030 | A1 * | 11/2010 | Youtsey | 81/124.2 |
| 2010/0282031 | A1 * | 11/2010 | Takeda et al. | 81/124.2 |

FOREIGN PATENT DOCUMENTS

| | | |
|---|---|---|
| DE | 35 15 102 | 10/1986 |

* cited by examiner

*Primary Examiner* — David B Thomas
(74) *Attorney, Agent, or Firm* — Kenyon & Kenyon LLP

(57) ABSTRACT

A socket wrench is described for installing a laser ignition system in an internal combustion engine, the socket wrench including a drive section and an output section that are situated axially one after another. The output section has a longitudinal recess.

12 Claims, 5 Drawing Sheets

SOCKET WRENCH FOR ASSEMBLING A LASER IGNITION SYSTEM

FIELD OF THE INVENTION

The present invention relates to a socket wrench for installing a laser ignition system in an internal combustion engine.

BACKGROUND INFORMATION

In contrast to ignition systems having conventional spark plugs, laser ignition systems in internal combustion engines have the advantage that the performance of the internal combustion engine is increased and pollutant emissions are reduced simultaneously. It may thus be assumed that the significance of laser ignition systems will increase in the future. Moreover, such laser ignition systems may be used in gas turbines.

A laser ignition device for igniting an air-fuel mixture in an internal combustion engine is discussed in DE 10 2004 001 554 A1, an ignition laser of the laser ignition device protruding into a combustion chamber of the internal combustion engine. The ignition laser is supplied optically from a pump light source via an optical fiber.

The laser ignition system may be made up of multiple components, essentially namely the ignition laser, the optical fiber and the pump light source which are detachably connected to one another. However, for reasons of functional reliability and for cost savings, the laser ignition system may be manufactured as a non-separable unit. This means that primarily in the case of the non-removable laser ignition systems, the ignition laser must be inserted into an opening provided for that purpose (ignition laser receptacle) in a cylinder head of the internal combustion engine without, for example, being able to remove the optical fiber in advance.

German patent document DE 35 15 102 C2 discusses a socket wrench for inserting a conventional spark plug into a cylinder head. A tubular socket wrench includes in this connection an internal wrench for fixing the spark plug and an outer jacket for accommodating the spark plug in a form-lock. Turning the outer jacket together with the internal wrench using a standard torque wrench makes it possible to screw the spark plug into a thread provided for the spark plug in the cylinder head. In this socket wrench, the ignition cable must be removed from the spark plug while the spark plug is installed in the cylinder head of the internal combustion engine.

SUMMARY OF THE INVENTION

An object of the exemplary embodiments and/or exemplary methods of the present invention is to provide an installation device, for example, a socket wrench for a laser ignition system in which the laser ignition system may be installed quickly and reliably in an internal combustion engine without having to separate the optical fiber from the ignition laser. The device should also be cost-effective.

This objective may be achieved by a socket wrench having the features described herein. The following description and the drawings contain significant features for the invention, it being possible for the features to be significant for the invention both alone and in various combinations, without it being necessary for this to be pointed out explicitly. Advantageous refinements are found in the subclaims.

An aspect of the exemplary embodiments and/or exemplary methods of the present invention is to provide a tool in which the ignition laser is inserted into the output section of the tool including at least the connected optical fiber, and the optical fiber is guided in the tool in such a way that it rotates during the installation. This avoids possible damage of the optical fiber caused by twisting. The longitudinal recess, which may, for example, be configured as a groove or slot, is provided in the output section for guiding the optical fiber in the tool. This makes it possible to install the laser ignition system in the internal combustion engine in a simple manner.

It is advantageous if a reinforcing tube is additionally situated as an outer jacket on the socket wrench at least in the output section. The socket wrench is hollow and the ignition laser may thus be inserted initially into an open end of the output section of the tool according to the present invention in the axial direction in a form-locked manner, and the optical fiber may be inserted radially into a slot of the tool according to the present invention. The form-locked connection may be produced, for example, by a hexagon, as is known from conventional spark plugs, or a double hexagon. In any case, the outer contour of the ignition laser and the inner contour of the tool according to the present invention must be coordinated in such a way that the necessary tightening torque may be transferred from the tool to the ignition laser.

Since the slot reduces the strength of the socket wrench, the risk exists that it will widen during tightening, so that the form-locked connection is lost and/or the ignition laser is damaged and a prescribed tightening torque is not achieved. In an additional specific inventive embodiment of the socket wrench according to the present invention, this is prevented by a coaxial reinforcing tube. In this way, the tool achieves adequate strength for tightening the ignition laser using the prescribed tightening torque. The use of the reinforcing tube is thus very effective and cost-efficient.

The reinforcing tube is rotatable on the socket wrench; however, it may also be displaceable on the socket wrench in the axial direction, so that the reinforcing tube may be brought into a desired position relative to the socket wrench by a rotational movement, a displacement movement in the axial direction or by combined rotational and displacement movements. It is possible to attach a marking on the outside of the socket wrench which indicates that the reinforcing tube is in the correct axial position in relation to the socket wrench for the installation.

A clearance fit is present between an outside diameter of the socket wrench and an inside diameter of the reinforcing tube, at least in the tool's output section. If the socket wrench opens slightly under load caused by the tightening torque, it comes into contact with the reinforcing tube so that this contributes to the strength of the entire tool. In a first variant of the tool, the clearance fit may also be applied over the entire length of the reinforcing tube. In a second variant of the tool, a transition fit may also be selected, which may possibly be more difficult to rotate but contributes to greater strength.

It is advantageous in particular if the reinforcing tube also has a longitudinal recess. The longitudinal recess may, for example, be configured as a groove or slot; the longitudinal recess of the reinforcing tube may have the same configuration as the longitudinal recess in the socket wrench.

The reinforcing tube may be continuously slotted and may be long enough that it protrudes from the ignition laser receptacle in the cylinder head during installation. When the ignition laser including the optical fiber is inserted, the positions of the longitudinal recesses in the socket wrench and reinforcing tube coincide so that the optical fiber may be inserted into the tool without difficulty. After that, the reinforcing tube is rotated by at least 45°, which may be by 180°, by a maximum of 315°.

If the reinforcing tube has been rotated by 180° in relation to the socket wrench after insertion of the optical fiber, the longitudinal recess of the socket wrench and the slot of the reinforcing tube are diametrically opposed and the optical fiber is located in the longitudinal recess of the socket wrench. Now the ignition laser may be screwed into the cylinder head of the internal combustion engine with the aid of the tool according to the present invention and tightened using the prescribed torque. After installation, the reinforcing tube may be turned back so that the longitudinal recesses of the socket wrench and reinforcing tube coincide again. The tool may now be removed easily from the ignition laser and from the optical fiber.

In order to make rotating the reinforcing tube easier, the reinforcing tube has a structure on one outer surface, in particular a knurl. This makes the entire device easier to handle and is cost-effective to manufacture.

If the longitudinal recess of the socket wrench is longer than the reinforcing tube, the optical fiber may protrude from the longitudinal recess of the socket wrench above the reinforcing tube, even if the slot of the reinforcing tube is rotated in relation to the longitudinal recess of the socket wrench, and the tool according to the present invention is thus "closed." This makes it possible for the optical fiber to be guided out of the socket wrench outside of the ignition laser receptacle. The fact that the socket wrench includes an extension section between the drive section and the output section in order to conform to the depth of the laser ignition receptacle provides additional support. The longitudinal recesses in the socket wrench and in the reinforcing tube are of course continued in the extension section.

In an alternative embodiment, the socket wrench is only formed as a slotted hollow cylinder in the output section, and above it makes a tapered transition to a solid material, for example, a round bar. The longitudinal recess of the socket wrench ends in the taper. The optical fiber is then routed in the drive section (and in the extension section, if present) next to the round bar, but within the reinforcing tube.

It is also possible that the reinforcing tube has a locking device against twisting in relation to the socket wrench. This prevents the reinforcing tube from being unintentionally twisted in relation to the socket wrench during the installation. The locking device may, for example, be active in the 180° position by, for example, engaging a spring-loaded bolt in the socket wrench in the longitudinal recess of the reinforcing tube. This is a simple, effective and cost-efficient implementation.

In order to tighten the ignition laser using the prescribed tightening torque, it is advantageous if the socket wrench has a standardized polygon, in particular a square, at the free end of the drive section. The polygon may be situated on the inside of the socket wrench or also externally on its periphery. A standard torque wrench may be used for rotating the ignition laser on the polygon. The torque wrench may also be fixedly connected to the reinforcing tube as a variant, making the torque wrench an integral component of the tool, which may possibly also be folded up by using a joint for saving space.

It is also advantageous that the socket wrench according to the present invention may have a mounting device for a pump light source of the laser ignition system. In the area of the tool above the ignition laser receptacle, a plate, for example, is fastened to the socket wrench, on which the pump light source may be fastened temporarily for the installation. This may be accomplished, for example, by using at least one knurled nut, the bolts engaging in mounting holes of the pump light source, or also by other quick fasteners, e.g., clamps or hook and loop fasteners. A simple insertion or suspension of the pump light source in a form-locked receptacle on the socket wrench may also be adequate. After the socket wrench is removed, the pump light source (including the connected optical fiber) is finally fastened to a mounting rail of the internal combustion engine.

After exiting from the longitudinal recesses, the optical fiber is routed up to the pump light source laterally adjacent to the socket wrench. If the optical fiber is of a greater length, it may be advantageous to attach a mounting device for the optical fiber in addition to the mounting device for the pump light source, in order to avoid damage to the optical fiber during the installation.

An exemplary embodiment of the present invention will be explained below with reference to the figures.

DETAILED DESCRIPTION

Laser ignition systems in internal combustion engines have advantages compared to ignitions having conventional spark plugs, since they offer optimized combustion systems. It may thus be assumed that the significance of laser ignition systems will increase in the future.

Figure 2:
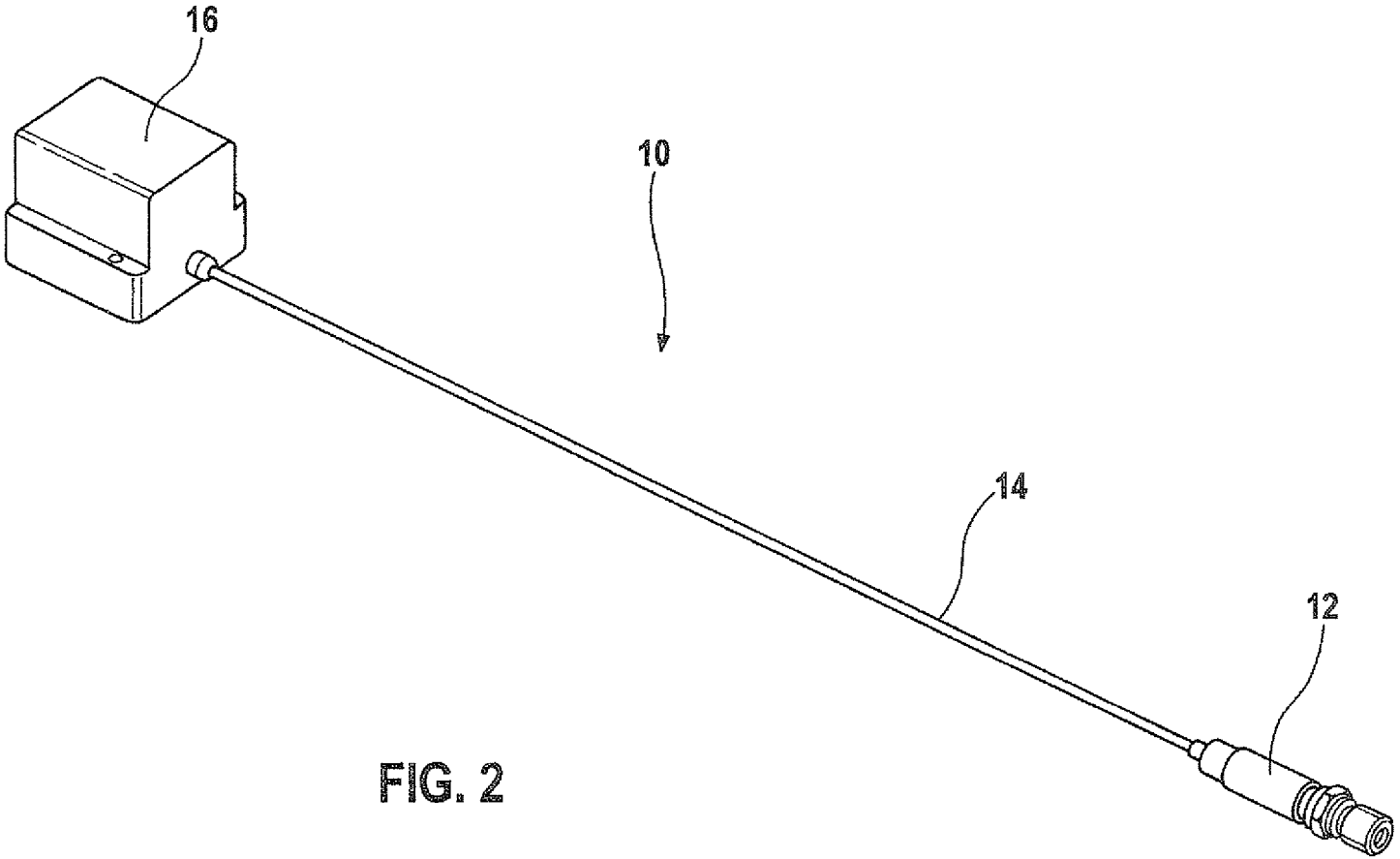
FIG. 2 shows a laser ignition system for an internal combustion engine.

FIG. 2 shows such a laser ignition system 10, an ignition laser 12 being supplied with pump light from a pump light source 16 via an optical fiber 14. During operation, ignition laser 12 protrudes into a combustion chamber of the internal combustion engine (not shown in FIG. 2) and is fastened by a thread in a cylinder head of the internal combustion engine (see in this regard the description for FIG. 6). A fuel-air mixture present in the combustion chamber is ignited with the aid of a laser pulse which is emitted by ignition laser 12 into the combustion chamber (not shown). After having been produced for improving functional reliability and for cost savings, laser ignition system 10 may represent a no longer separable unit. Of course, the components may also be produced individually and not be assembled until just before installation.

Figure 1:
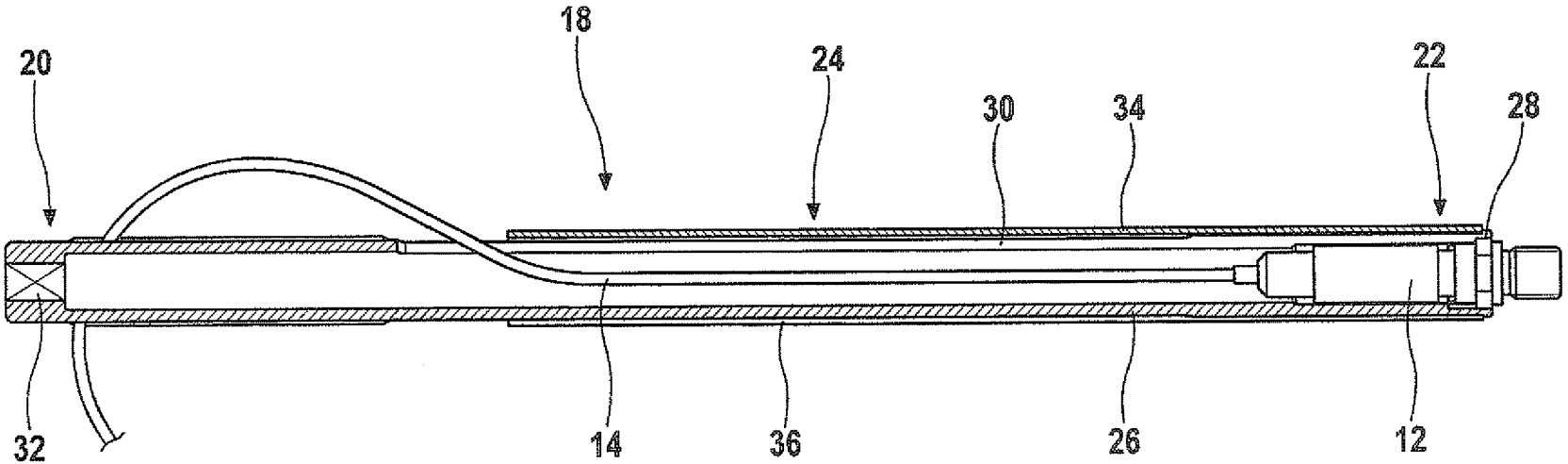
FIG. 1 shows a schematic representation of a socket wrench according to the present invention in cross section.

Laser ignition system 10 is installed in the internal combustion engine with the aid of a tool according to the present invention. FIG. 1 shows such a tool. It is denoted in its entirety by reference numeral 18. Tool 18 may be made from metal, for example, steel, and is broken down into three sections: The tool has a drive section 20 on the left side of FIG. 1, an output section 22 on the right side and an extension section 24 between them. Tool 18 includes a socket wrench 26 which is in the shape of a tube and accommodates ignition laser 12 in a form-lock 28 in output section 22.

Form-lock 28 may be a hexagon or a double hexagon. Moreover, socket wrench 26 has a longitudinal recess 30 which extends from output section 22 to the vicinity of drive section 20. Longitudinal recess 30 may be configured as a groove or slot in tubular socket wrench 26 and is used for accommodating optical fiber 14 during the installation of ignition laser 12.

Drive section 20 has a standardized square drive 32 formed in the interior of socket wrench 26. Alternatively, a polygon formed on the outside, for example, a hexagon may be used as a drive.

In output section 22 and partially in extension section 24, socket wrench 26 is jacketed by a reinforcing tube 34. Reinforcing tube 34 has a clearance fit in relation to socket wrench 26, so that reinforcing tube 34 is rotatable in relation to socket wrench 26. In the exemplary embodiment represented, reinforcing tube 34 is shorter than longitudinal recess 30 of socket wrench 26. Reinforcing tube 34 has a longitudinal recess 36 over its entire length which may be configured as a groove or slot.

Figure 3:
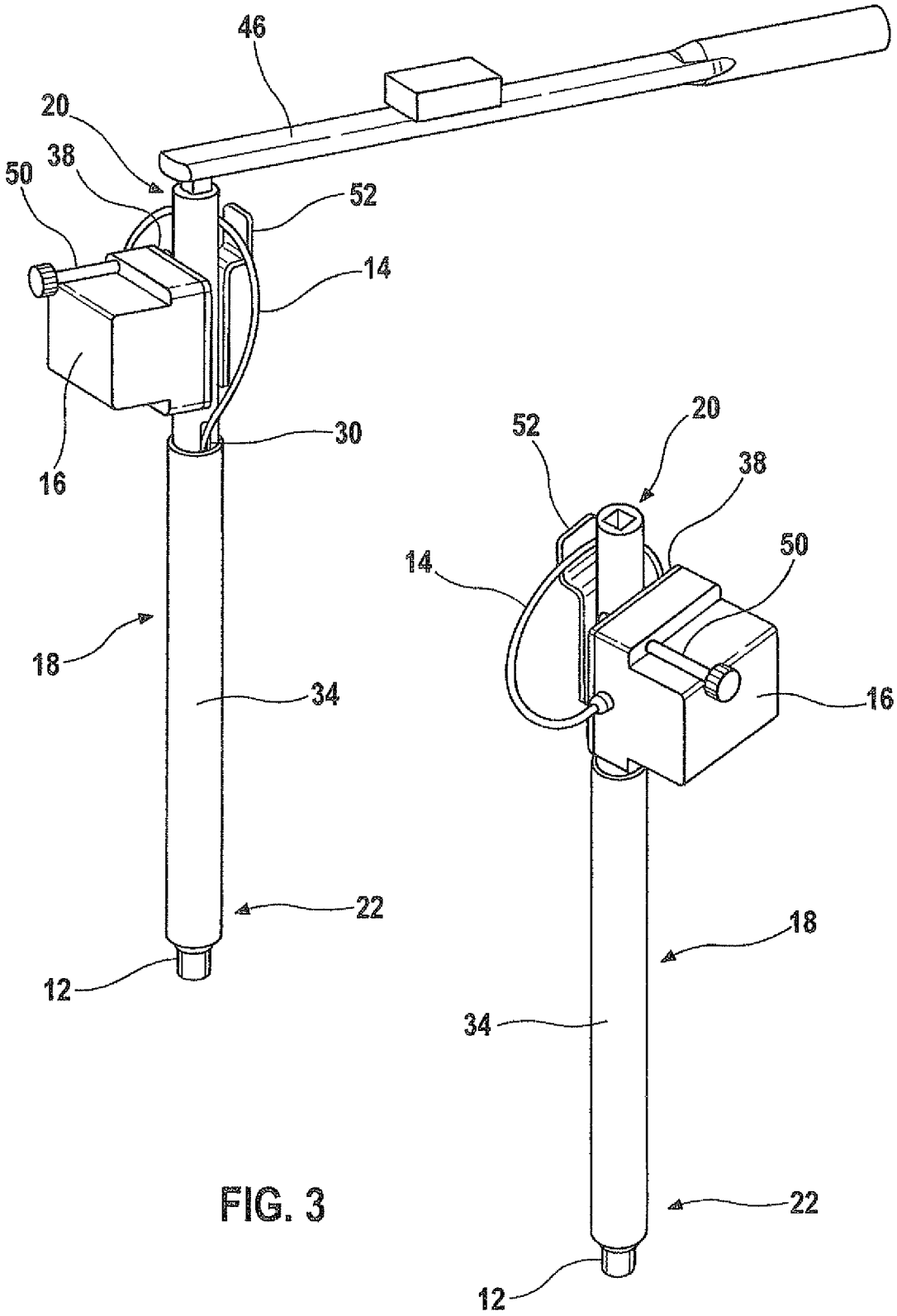
FIG. 3 shows the socket wrench from FIG. 1 in a perspective representation including an inserted laser ignition system.
Figure 4:
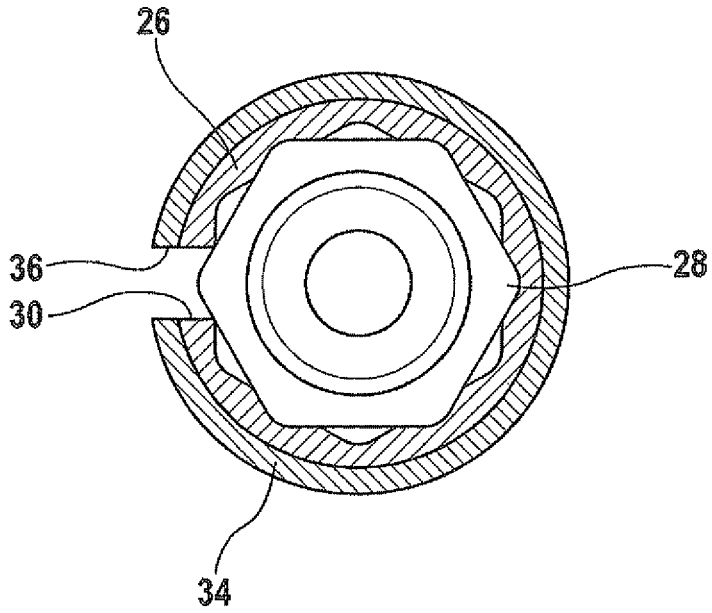
FIG. 4 shows the socket wrench from FIG. 1 in a radial section including longitudinal recesses lying one above the other.

FIG. 3 shows tool 18 from two perspectives including inserted laser ignition system 10 as it must be set up before installation in an internal combustion engine. The following work steps are necessary for this purpose:

Longitudinal recess 30 of socket wrench 26 and longitudinal recess 36 of reinforcing tube 34 are placed into a position above one another by rotation. FIG. 4 shows this position of reinforcing tube 34 and socket wrench 26. Ignition laser 12 is then inserted axially into output section 22 of tool 18 in a form-locked manner and optical fiber 14 connected to ignition laser 12 is inserted radially into longitudinal recesses 30 and 36 which lie above one another. Since longitudinal recess 30 of socket wrench 26 is longer than reinforcing tube 34, optical fiber 14 in FIG. 3 may be guided to the outside above reinforcing tube 34.

Pump light source 16 which is connected to optical fiber 14 is fastened to a mounting device 38. As is apparent in FIG. 3, pump light source 16 is fastened (temporarily during installation) to mounting device 38. Mounting device 38 is configured as a mounting plate 38 and is situated on socket wrench 26 in the area of drive section 20. For fastening, a bolt 50 (including a knurled nut connected to it) is inserted through a mounting hole of the pump light source and, for example, connected temporarily with a thread in bolt 50 and mounting plate 38. In order not to endanger optical fiber 14 emerging from longitudinal recess 30 during installation, an additional mounting bracket 52 is provided for optical fiber 14. Mounting bracket 52 includes an angle plate fastened to socket wrench 26.

Figure 5:
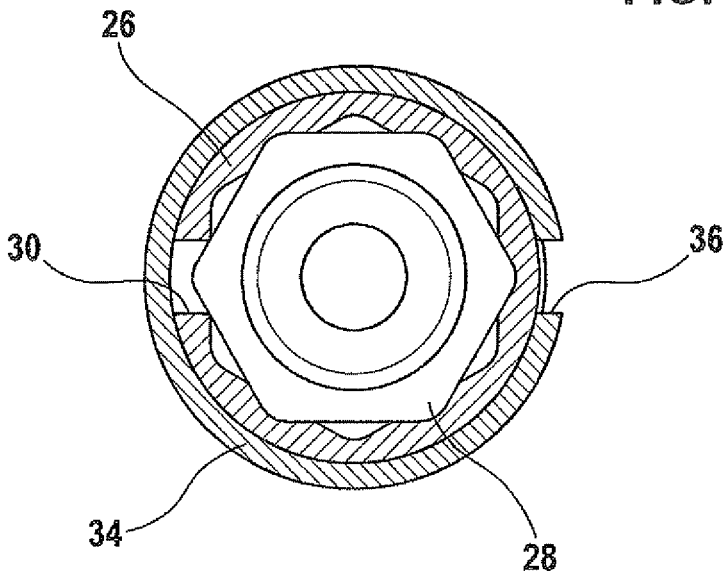
FIG. 5 shows the socket wrench from FIG. 1 in a radial section including longitudinal recesses which are rotated by 180°.

Reinforcing tube 34 is now rotated by at least 45° or a maximum of 315°, which may be 180°, so that optical fiber 14 is guided in longitudinal recess 30 of socket wrench 26 and covered by reinforcing tube 34. FIG. 5 shows these positions of reinforcing tube 34 and socket wrench 26. In this condition, the ignition laser may be installed with the aid of tool 18 according to the present invention.

Figure 6:
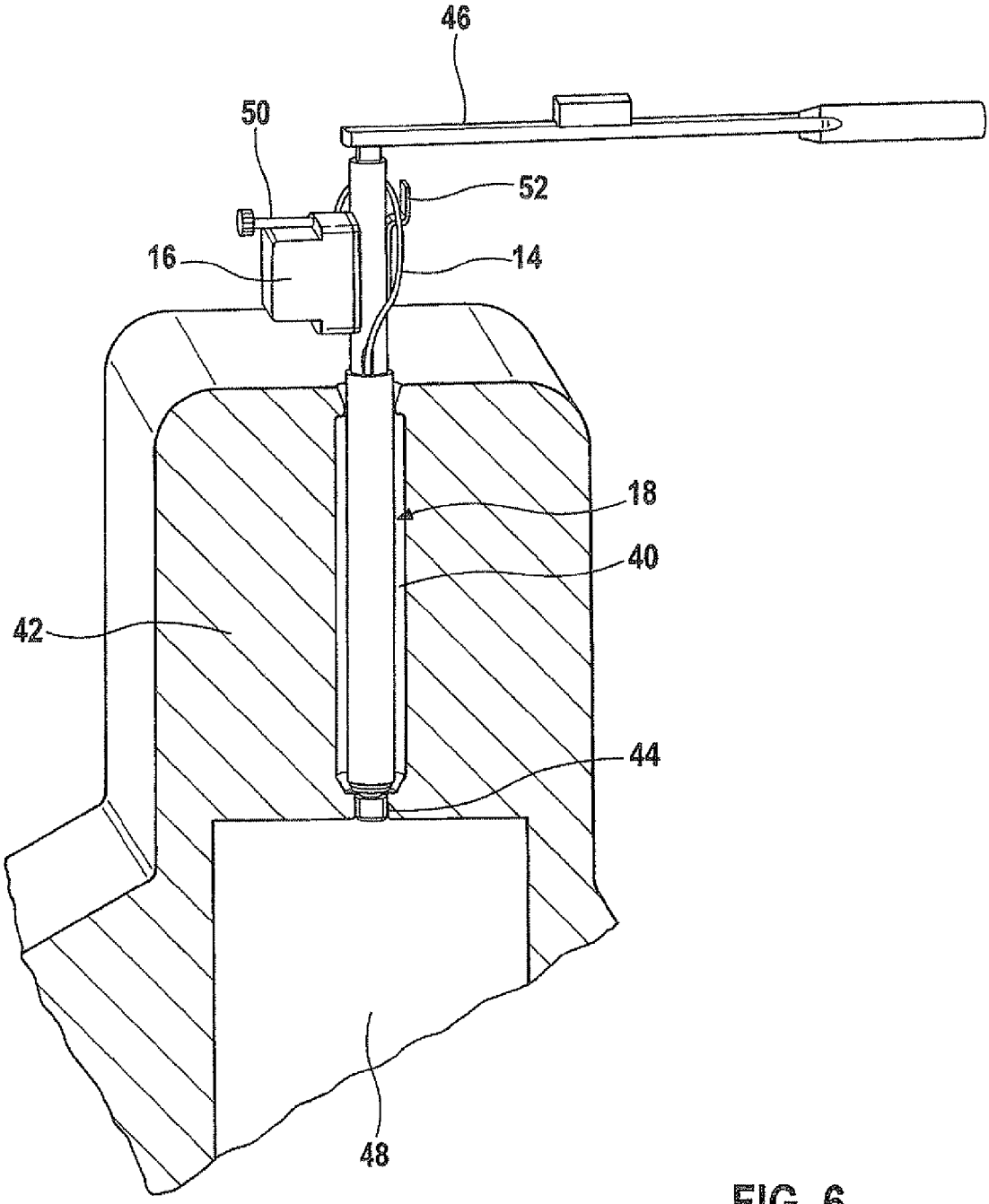
FIG. 6 shows the socket wrench from FIG. 1 during an installation in an internal combustion engine in a perspective cross-sectional representation.

The installation of laser ignition system 10 in the internal combustion engine is explained with reference to FIG. 6. For installation, tool 18 including the inserted ignition laser is inserted into a receptacle 40 of cylinder head 42 of the internal combustion engine provided for that purpose, so that the free end of ignition laser 12 is in contact with a prepared thread 44 in cylinder head 42. The bore of thread 44 creates an access to combustion chamber 48 of the internal combustion engine. A torque wrench 46 is inserted into square drive 32. By turning torque wrench 46, ignition laser 12 including optical fiber 14 connected to it and pump light source 16 also connected to it is screwed into thread 44 using a predefined tightening torque without optical fiber 14 being twisted. Pump light source 16 is then removed from mounting bracket 38 and is fastened to a prepared mounting rail of the internal combustion engine (not shown). Reinforcing tube 34 is now rotated into the starting position having longitudinal recesses 30 and 36 lying one above the other. Tool 18 may be removed from ignition laser receptacle 40. At the same time, optical fiber 14 may slide out of the recesses of tool 18 unimpeded.

What is claimed is:

1. A socket wrench for installing a laser ignition system in an internal combustion engine, comprising:

a drive section; and an output section, wherein the drive section and the output section are situated axially one after another, and wherein the output section has a longitudinal recess; and a reinforcing tube situated as an outer jacket on the socket wrench at least in the output section and having a locking device against twisting in relation to the socket wrench.

2. The socket wrench of claim 1, wherein the reinforcing tube has a longitudinal recess.

3. The socket wrench of claim 1, wherein the socket wrench is at least one of rotatable and displaceable in relation to the reinforcing tube.

4. The socket wrench of claim 3, wherein the socket wrench is rotatable in relation to the reinforcing tube by at least 45° and up to a maximum of 315°.

5. The socket wrench of claim 1, wherein the socket wrench includes an extension section between the drive section and the output section.

6. The socket wrench of claim 1, wherein the socket wrench has a standardized polygon, which is a square, at the free end of the drive section.

7. The socket wrench of claim 1, wherein the socket wrench has a mounting device for a pump light source of the laser ignition system.

8. The socket wrench of claim 1, wherein the socket wrench has a form-lock for accommodating an ignition laser at one free end of the output section.

9. A socket wrench for installing a laser ignition system in an internal combustion engine, comprising:

a drive section;

an output section, wherein the drive section and the output section are situated axially one after another, and wherein the output section has a longitudinal recess; and a reinforcing tube situated as an outer jacket on the socket wrench at least in the output section;

wherein the socket wrench is at least one of rotatable and displaceable in relation to the reinforcing tube;

wherein the socket wrench has a marking which indicates that the reinforcing tube is in the correct axial position in relation to the socket wrench for assembly.

10. A socket wrench for installing a laser ignition system in an internal combustion engine, comprising:

a drive section;

an output section, wherein the drive section and the output section are situated axially one after another, and wherein the output section has a longitudinal recess; and a reinforcing tube situated as an outer jacket on the socket wrench at least in the output section;

wherein the reinforcing tube has a structure on one outer surface, which is a knurl.

11. A socket wrench for installing a laser ignition system in an internal combustion engine, comprising:

a drive section;

an output section, wherein the drive section and the output section are situated axially one after another, and wherein the output section has a longitudinal recess; and a reinforcing tube situated as an outer jacket on the socket wrench at least in the output section and having a longitudinal recess;

wherein the longitudinal recess of the socket wrench is longer than the longitudinal recess in the reinforcing tube.

12. A socket wrench for installing a laser ignition system in an internal combustion engine, comprising:

a drive section;

an output section, wherein the drive section and the output section are situated axially one after another, and wherein the output section has a longitudinal recess;

a mounting device for a pump light source of the laser ignition system; and an additional mounting bracket for an optical fiber of the laser ignition system, including an angle plate.

* * * * *